US011667461B2

(12) United States Patent
Bodet et al.

(10) Patent No.: US 11,667,461 B2
(45) Date of Patent: Jun. 6, 2023

(54) DIFFUSER FOR A PRESSURIZED CONTAINER

(71) Applicant: LINDAL FRANCE SAS, Val de Briey (FR)

(72) Inventors: Hervé Bodet, Verdun (FR); Eric Gaillard, Dieue-sur-Meuse (FR)

(73) Assignee: LINDAL FRANCE SAS, Val de Briey (FR)

( * ) Notice: Subject to any disclaimer, the term of this patent is extended or adjusted under 35 U.S.C. 154(b) by 0 days.

(21) Appl. No.: 17/420,380

(22) PCT Filed: Jan. 21, 2020

(86) PCT No.: PCT/EP2020/051372
§ 371 (c)(1),
(2) Date: Jul. 1, 2021

(87) PCT Pub. No.: WO2020/152141
PCT Pub. Date: Jul. 30, 2020

(65) Prior Publication Data

US 2022/0097950 A1 Mar. 31, 2022

(30) Foreign Application Priority Data

Jan. 25, 2019 (FR) ..... 1900676

(51) Int. Cl.
*B65D 83/20* (2006.01)
*B65D 83/14* (2006.01)
(Continued)

(52) U.S. Cl.
CPC ..... *B65D 83/206* (2013.01); *B65D 83/205* (2013.01); *B65D 83/48* (2013.01); *B65D 83/753* (2013.01); *B65D 83/28* (2013.01)

(58) Field of Classification Search
CPC .... B65D 83/206; B65D 83/205; B65D 83/48; B65D 83/753; B65D 83/28
See application file for complete search history.

(56) References Cited

U.S. PATENT DOCUMENTS 3,058,626 A * 10/1962 Hibbs ..... B65D 83/206 222/182
4,328,911 A 5/1982 Knickerbocker
(Continued)

FOREIGN PATENT DOCUMENTS

AU 2007230663 B2 * 3/2011 ..... A61K 8/896
CA 2845909 A1 * 9/2014 ..... B05B 7/0876
(Continued)

OTHER PUBLICATIONS

International Search Report and Written Opinion dated Apr. 16, 2020 in corresponding application No. PCT/EP2020/051372; w/ English partial translation and partial machine translation (total 29 pages).

(Continued)

*Primary Examiner* — Bob Zadeh
(74) *Attorney, Agent, or Firm* — Seckel IP, PLLC

(57) ABSTRACT

The diffuser (1) for a pressurized container provided with a valve, in particular for an aerosol generator, includes a base body (10) formed of a concave wall forming a cavity, and having a finger tab (11) intended to be depressed by the user to operate the valve, and a conduit placed in the cavity of the base body (10). The conduit has a first end adapted for cooperating with the valve of the pressurized container, and a second end for the outlet of the product contained in the pressurized container. The outlet conduit and the base body are two distinct parts which are connected together by mechanical fastening. Optionally, the outlet conduit is prevented from rotating relative to the base body.

21 Claims, 6 Drawing Sheets

(51) Int. Cl.

| | |
|---|---|
| ***B65D 83/48*** | (2006.01) |
| *B65D 83/28* | (2006.01) |

(56) References Cited

U.S. PATENT DOCUMENTS

| | | | | |
|---|---|---|---|---|
| 4,416,399 | A | 11/1983 | Parr et al. | |
| 4,815,541 | A | 3/1989 | Arrington | |
| 6,006,957 | A | 12/1999 | Kunesh | |
| 6,089,410 | A * | 7/2000 | Ponton | B05B 11/0056 222/321.8 |
| 7,789,278 | B2 | 9/2010 | Ruiz de Gopegui et al. | |
| 9,382,059 | B2 | 7/2016 | Selinger et al. | |
| 10,064,472 | B2 | 9/2018 | Campbell et al. | |
| 2002/0108972 | A1* | 8/2002 | Bayer | B65D 83/206 222/402.13 |
| 2003/0089734 | A1 | 5/2003 | Eberhardt et al. | |
| 2004/0112924 | A1* | 6/2004 | Albisetti | B65D 83/205 222/402.13 |
| 2004/0245294 | A1 | 12/2004 | Mineau et al. | |
| 2007/0034653 | A1* | 2/2007 | Strand | B65D 83/206 222/402.13 |
| 2007/0051754 | A1* | 3/2007 | Strand | B65D 83/206 222/402.13 |
| 2007/0290007 | A1* | 12/2007 | Eberhardt | B65D 83/206 239/577 |
| 2008/0164345 | A1 | 7/2008 | Belau et al. | |
| 2008/0221561 | A1* | 9/2008 | Geiger | B65D 83/303 606/22 |
| 2008/0251547 | A1* | 10/2008 | Ruiz de Gopegui | B05B 7/2435 239/308 |
| 2009/0321381 | A1 | 12/2009 | Paas et al. | |
| 2010/0147898 | A1* | 6/2010 | Blumenstein | B65D 83/206 222/402.13 |
| 2013/0037582 | A1 | 2/2013 | Andersen et al. | |
| 2013/0320041 | A1 | 12/2013 | Selinger et al. | |
| 2015/0014368 | A1* | 1/2015 | Greiner-Perth | B65D 83/201 222/402.13 |
| 2015/0050425 | A1 | 2/2015 | Hanson et al. | |
| 2015/0251202 | A1 | 9/2015 | Ogata et al. | |
| 2016/0221744 | A1 | 8/2016 | Coppus et al. | |
| 2017/0233171 | A1 | 8/2017 | Christianson et al. | |
| 2018/0118444 | A1* | 5/2018 | Bodet | B65D 83/22 |
| 2019/0283959 | A1 | 9/2019 | Rasel et al. | |
| 2020/0062489 | A1 | 2/2020 | Spang, Jr. et al. | |
| 2022/0081187 | A1 | 3/2022 | Gaillard et al. | |
| 2022/0081188 | A1 | 3/2022 | Gaillard et al. | |
| 2022/0097950 | A1* | 3/2022 | Bodet | B65D 83/205 |
| 2022/0097951 | A1 | 3/2022 | Gaillard et al. | |

FOREIGN PATENT DOCUMENTS

| | | | | |
|---|---|---|---|---|
| DE | 102007049614 | A1 * | 9/2008 | B05B 11/0027 |
| EP | 2551214 | A1 | 1/2013 | |
| EP | 2741974 | | 6/2014 | |
| EP | 3251753 | A1 | 12/2017 | |
| FR | 2429161 | A1 | 1/1980 | |
| FR | 2556242 | A * | 6/1985 | A61L 9/12 |
| FR | 2556242 | A1 | 6/1985 | |
| FR | 2881721 | A1 | 8/2006 | |
| GB | 2023745 | A | 1/1980 | |
| JP | H0835971 | A * | 2/1996 | |
| WO | 2011111244 | A1 | 9/2011 | |
| WO | 2013023036 | A1 | 2/2013 | |
| WO | 2018086831 | A1 | 5/2018 | |
| WO | 2021148382 | A1 | 7/2021 | |

OTHER PUBLICATIONS

International Preliminary Report on Patentability dated Oct. 19, 2020 in corresponding application No. PCT/EP2020/051372; w/ English machine translation (total 31 pages).

International Search Report and Written Opinion dated Apr. 23, 2020 in application No. PCT/EP2020/051335 orresponding to co-pending U.S. Appl. No. 17/423,963 claiming priority of priority application No. FR190676; w/ English translation (total 23 pages) (FR2556242, US20150014368, FR2429161, FR2881721, D1 and D3-D5 cited in the ISR are not listed in this IDS since they were already listed in the IDS filed Jul. 1, 2021).

International Search Report and Written Opinion dated Apr. 22, 2020 in application No. PCT/EP2020/051336 orresponding to co-pending U.S. Appl. No. 17/423,974 claiming priority of priority application No. FR190676; w/ English translation (total 19 pages) (US20150014368, D4 cited in the ISR is not listed in this IDS since it was already listed in the IDS filed Jul. 1, 2021).

International Search Report and Written Opinion dated Apr. 17, 2020 in corresponding application No. PCT/EP2020/051337 corresponding to co-pending U.S. Appl. No. 17/423,987 claiming priority of priority application No. FR190676; w/ English translation (total 21 pages) FR2556242, FR2429161, US20150014368, D2-D4 cited in the ISR are not listed in this IDS since they were already isted in the IDS filed Jul. 1, 2021).

Office Action dated Jul. 11, 2022 in co-pending U.S. Appl. No. 17/423,963; with PTO892; without returned SB08 (total 10 pages) (Note: refs. B-E, G, I, and N cited in the Office Action are not listed in this IDS since they are already of record).

EP Office Action dated Feb. 9, 2023 in application No. EP20700735.2, counterpart of co-pending U.S. Appl. No. 17/423,974; with machine translation (total 11 pages) (Note: EP3251753, D1, and US10064472, D2 cited in the Office Action are not listed in this IDS since they are already of record).

* cited by examiner

DIFFUSER FOR A PRESSURIZED CONTAINER

TECHNICAL FIELD

The invention relates to a diffuser for a pressurized container provided with a valve, in particular for an aerosol generator, which diffuser is provided with a base body formed by a wall having a concave inner face forming a cavity, and having a finger tab intended to be depressed by the user to actuate the valve, and an outlet conduit placed in the cavity of the base body, which conduit has a first end provided with means for cooperating with the valve of the pressurized container, and a second end for the outlet of the product contained in the pressurized container.

STATE OF THE ART

Such diffusers are commonly used in many fields, such as cosmetics or household products. The finger tab can be an integral portion of the base body to which it is connected by a strip. It can also be a separate part that can be depressed either in a vertical translational movement or in a tilting movement around a support. The outlet conduit is molded either directly on the inner face of the finger tab, or on a fixing ring which is used to fix the diffuser on the pressurized container. The outlet conduit must be made of a material compatible with the product contained in the pressurized container. Therefore, not just the outlet conduit is made in this material, but also the entire finger tab or the entire fixing ring. In contrast, the choice of the material of the finger tab or of the fixing ring tends to be dictated by the mechanical properties that these parts must have. The material chosen must therefore meet many requirements which sometimes considerably limit the choice. To work around this problem, it is also possible to overmold the outlet conduit on the finger tab or on the fixing ring. This requires the materials to be compatible with one another and triggers substantial additional costs.

DISCLOSURE OF THE INVENTION

The objective of the invention is to provide a diffuser in which the choice of the material of the outlet conduit and that of the base body are dictated only by the properties sought for each of them, the diffuser also having to be economical to manufacture.

This objective is achieved in that the outlet conduit and the base body are two distinct parts which, after assembly, are connected together by mechanical fastening means. Anti-rotation means can be provided to prevent the outlet conduit from rotating relative to the base body. All kinds of snap-fastening means can be used.

It is thus possible that the material used for the base body and the material used for the outlet conduit are of different compositions and/or of different colors. It is thus possible to limit the use of a material compatible with the product contained in the pressurized container solely to the outlet conduit, a relatively small part, whereas the material for the base body will be chosen for its mechanical properties, its lower cost, its aesthetics, etc.

The mechanical fastening means can be constituted, for example, by a fastening tenon placed on the outlet conduit or in the cavity of the base body, and a fastening hole made either in the wall of the base body and opening into the cavity, or on the outlet conduit. The fastening hole is either a blind hole or a through hole. In particular, the fastening tenon can be placed on the outlet conduit and the fastening hole can be made in the base body, preferably in the finger tab. The fastening tenon can include a cap connected to the outlet conduit by a rod which ends with a shoulder opposite the cap. The fastening hole is preferably a hole that passes through the wall of the base body and comprises at least a first portion, called the inner portion, the greatest transverse extension of which is less than the greatest transverse extension of the cap of the fastening tenon, the length of the rod of the tenon being chosen so that, in the fastened state of the outlet conduit, the wall of the base body at the edge of the fastening hole is located between the cap and the shoulder, the transverse cross-section of the cap and the transverse cross-section of the inner portion being chosen so that when fastening the outlet conduit to the base body, the cap can be introduced by force into the inner portion of the fastening hole without risking damage to the outlet conduit or to the base body. Due to its greater transverse extension, the cap can pass through the first portion of the fastening hole only by force, both in the direction of fastening and in the other direction. In other words, after being fastened, the outlet conduit cannot come off on its own. In practice, the fastening means are designed so that the entire transverse cross-section of the cap is larger than the transverse cross-section of the first portion of the fastening hole.

It is preferable that the inner portion of the fastening hole continues with a second portion, called the outer portion, the inner portion opening into the cavity of the base body and the outer portion opening to the outside of the base body, the transverse cross-section of the outer portion being dimensioned to contain the transverse cross-section of the cap of the fastening tenon. In order to allow continuity of the outer surface of the finger tab at the fastening tenon, the length of the outer portion of the fastening hole is preferably substantially identical to the height of the cap so that the latter is flush with the outer face of the base body.

In a preferred embodiment of the invention, the outlet conduit comprises a first section which is substantially rectilinear and a second section, the first section starting at the first end of the outlet conduit and ending at the junction with the second section. The fastening tenon is placed at the top of the first section opposite the first end, or on the second section. The fastening opening is made in the finger tab.

To prevent the outlet conduit from pivoting in the base body during storage, transport or installation of the diffuser on a pressurized container, it is preferable to provide anti-rotation means. In a first variant embodiment, the anti-rotation means are constituted by a tight fit of the fastening tenon in the fastening hole. In particular, the greatest transverse extension of the fastening tenon, in particular of the rod of the fastening tenon, can be greater than the greatest transverse extension of at least a portion of the fastening hole, in particular of the inner portion of the fastening hole. In particular, the transverse cross-section of the rod can be greater than the transverse cross-section of the fastening hole, in particular of the lower portion. In this case, the fastening tenon is introduced by force into the fastening hole.

In another variant embodiment, the anti-rotation means are constituted by an interlocking of shapes of the fastening tenon in the fastening hole. For example, the rod of the fastening tenon can be fitted by interlocking into the inner portion of the fastening hole. For this to work, the transverse cross-section of the fastening tenon, in particular of the rod of the fastening tenon, and the transverse cross-section of the fastening hole, in particular of the inner portion of the fastening hole, must not have a symmetry of revolution.

A second solution consists in making the anti-rotation means in the form of an interlocking of shapes of the cap of the fastening tenon in the outer portion of the fastening hole. The transverse cross-section of the cap of the fastening tenon and the transverse cross-section of the outer portion of the fastening hole do not have a symmetry of revolution.

A simple solution is to design the transverse cross-section of the rod of the fastening tenon and that of the inner portion of the fastening hole, or the transverse cross-section of the cap of the fastening tenon and that of the outer portion of the fastening hole, so that they are complementary. It is possible for example to choose two square sections, or more generally, polyhedral sections. However, it is not essential for the shapes to be complementary, for example, one can choose a hexagonal section for the fastening hole and a triangular section for the fastening tenon or the cap, the angles of the triangle then being in correspondence with every other angle of the fastening hole. More generally, it is sufficient for the transverse cross section of the outer portion of the fastening hole to be circumscribed to the transverse cross-section of the cap.

In a third solution, the anti-rotation means are constituted by two guide lugs placed in the cavity of the base body and which surround a portion of the outlet conduit while preventing the latter from pivoting around the fastening tenon.

The material used for the base body and the material used for the outlet conduit can be of different compositions and/or of different colors. In a particular variant, the fastening hole is a through hole, and the end of the fastening tenon opposite the rest of the outlet conduit, in particular the cap, has a particular shape and/or color which, in the fastened state of the outlet conduit, is/are visible and recognizable from the outside of the diffuser and constitute(s) means of identification or information for the user.

The base body is preferably provided with fixing means to fix it directly or via a ferrule to a pressurized container.

An orifice is generally made in the wall of the base body, facing the second end of the outlet conduit and at a distance from the fastening hole. The orifice can be placed in a recess of the wall of the base body. This recess, viewed from outside the base body, preferably has a concave shape.

Preferably, at least a portion of the base body and/or at least a portion of the outlet conduit is/are made in a recycled material, in a biodegradable material, in a compostable material or in a biomaterial, or a mixture of these.

The base body can be made in a material chosen from a polymer material, in particular polyethylene (PE), polypropylene (PP), polylactic acid (PLA), polyhydroxyalkanoates (PHA), poly(butylene succinate) (PBS), or a mixture thereof, which polymer may contain mineral fillers, in particular glass and/or basalt, and/or be reinforced with mineral or vegetable fibers, a lignin-based material, preferably cardboard and/or wood, a material containing textiles, a metal, a mixture of these materials.

The outlet conduit can be made in a food grade and/or cosmetic grade and/or pharmaceutical grade and/or medical grade material. Thus, it should be understood that the material used complies with the existing standards concerning materials intended to come into contact with food, cosmetic, pharmaceutical or medical products.

In particular, the outlet conduit can be made in a material chosen from:

a polymer material, preferably polyethylene (PE), polypropylene (PP), polyoxymethylene (POM), poly(butylene terephthalate) (PBT), polyamide (PA), or a mixture thereof, a metal, preferably aluminum or steel, in particular stainless steel.

Preferably, the outlet conduit is made in a virgin material and the main body is made at least in part in a recycled material.

It is self-evident that the base body and the outlet conduit can be sold separately. The invention therefore also relates on the one hand to a base body and on the other hand to an outlet conduit for a diffuser according to the invention with all or part of the characteristics described for each of them.

BRIEF DESCRIPTION OF THE FIGURES

The invention is described in more detail below with the aid of the figures which show.

DETAILED DESCRIPTION OF THE INVENTION

Figure 1:
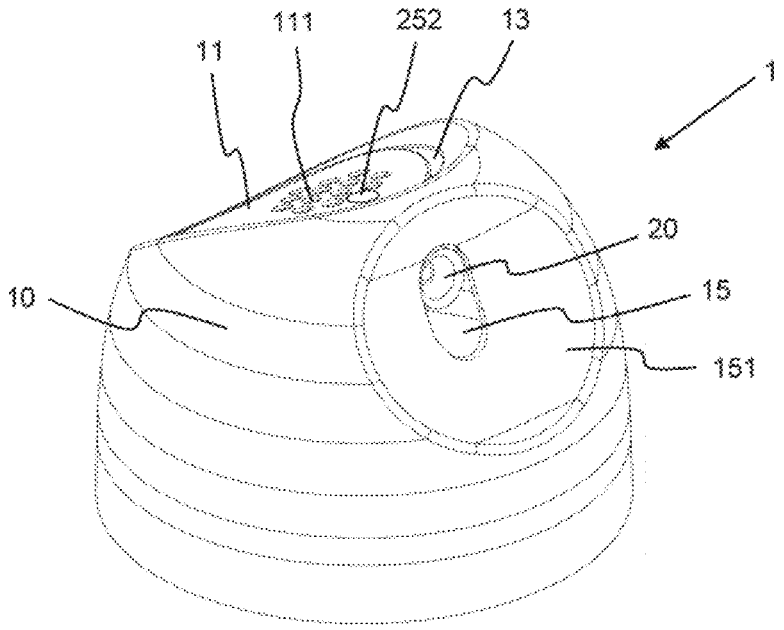
FIG. 1: A perspective view of the diffuser according to the invention.
Figure 2:
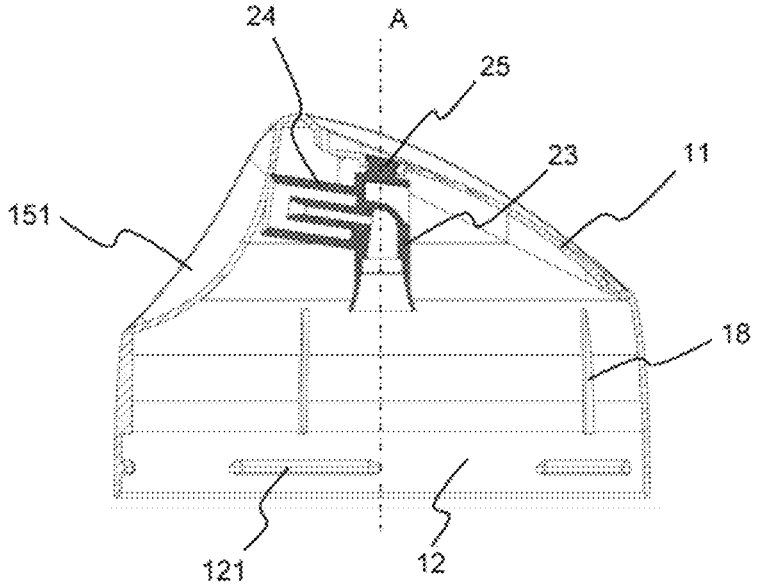
FIG. 2: A longitudinal cross-sectional view of the diffuser of FIG. 1.
Figure 3:
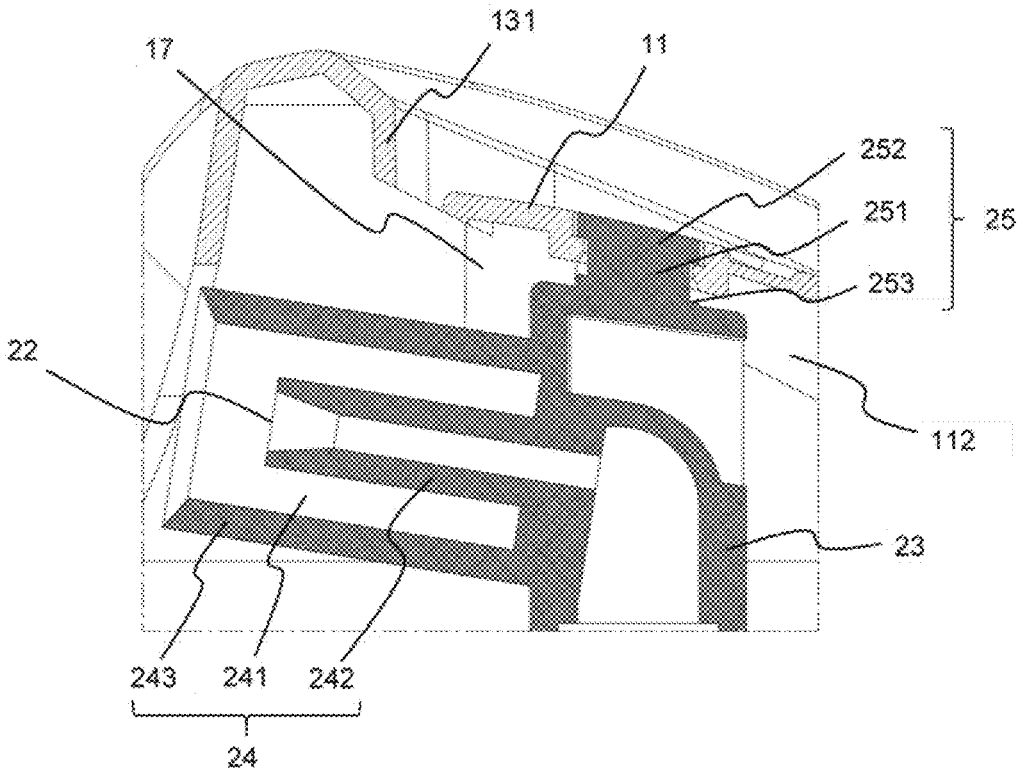
FIG. 3: An enlargement of the cross-sectional view of FIG. 2 at the fastening means of the outlet conduit.
Figure 4:
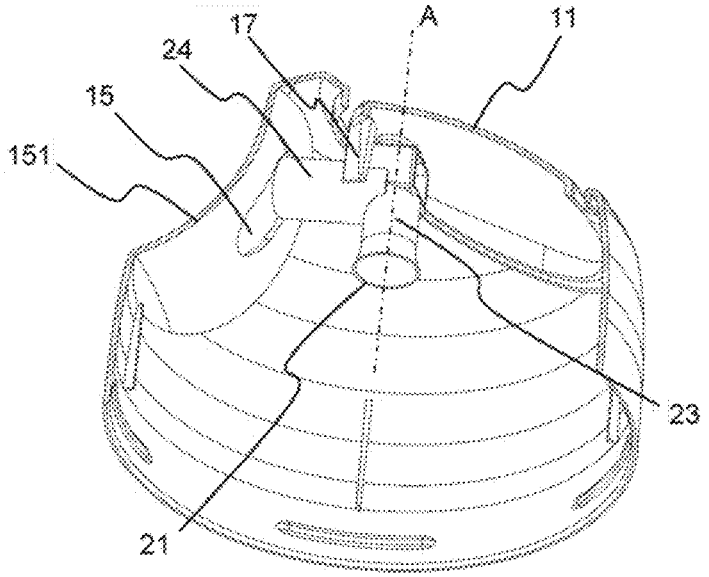
FIG. 4: A perspective view of an off-center transverse cross-section of the diffuser showing the anti-rotation means.
Figure 5:
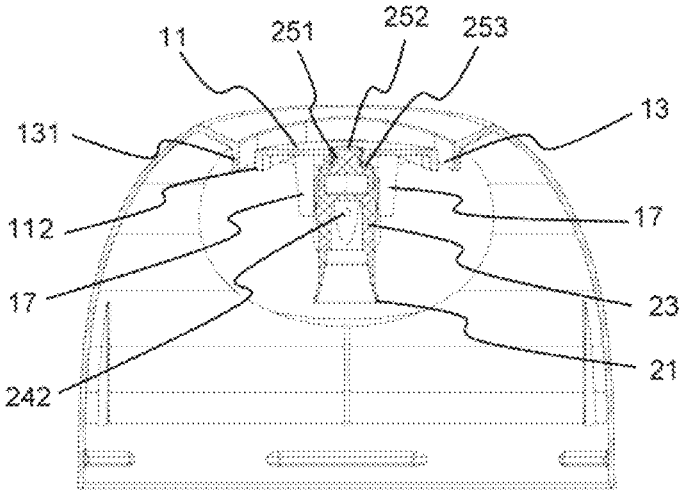
FIG. 5: A transverse cross-sectional view of the diffuser of FIG. 1.
Figure 6:
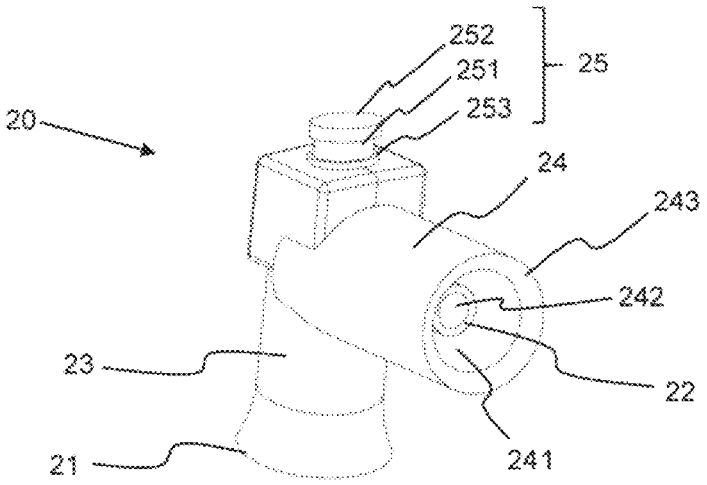
FIG. 6: A perspective view of the outlet conduit.
Figure 7:
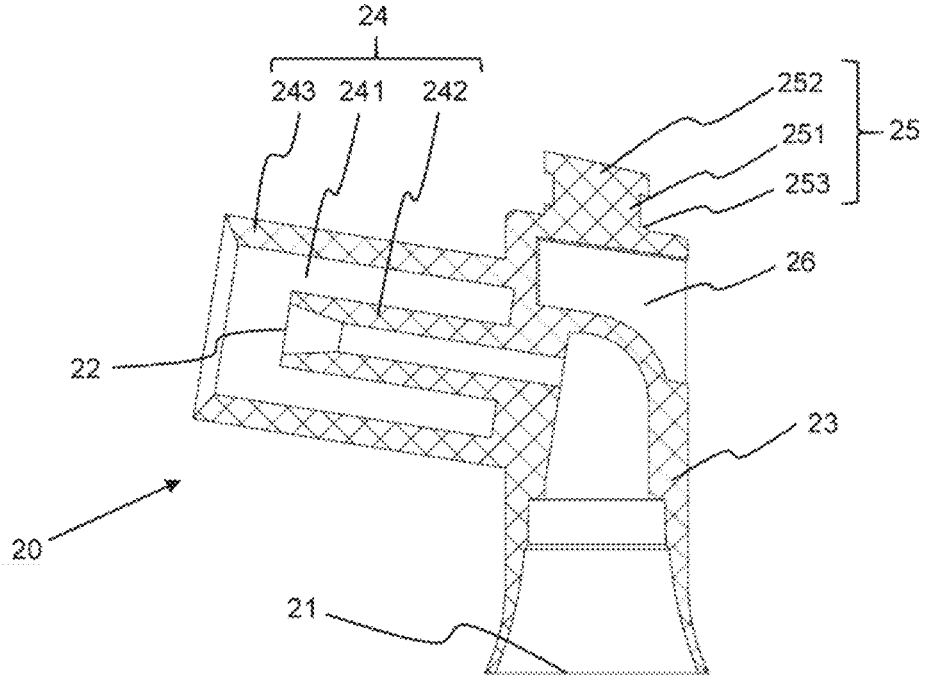
FIG. 7: A longitudinal cross-sectional view of the outlet conduit of FIG. 6.
Figure 8:
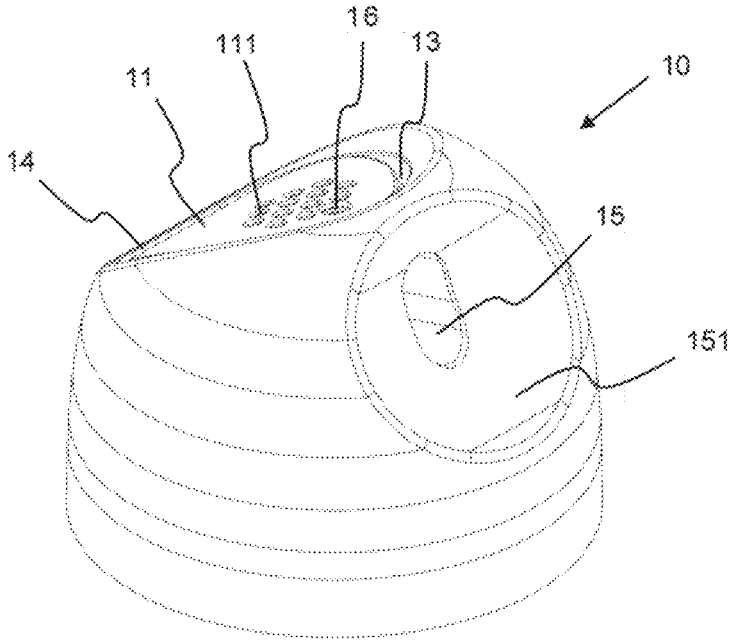
FIG. 8: A perspective view of the base body.
Figure 9:
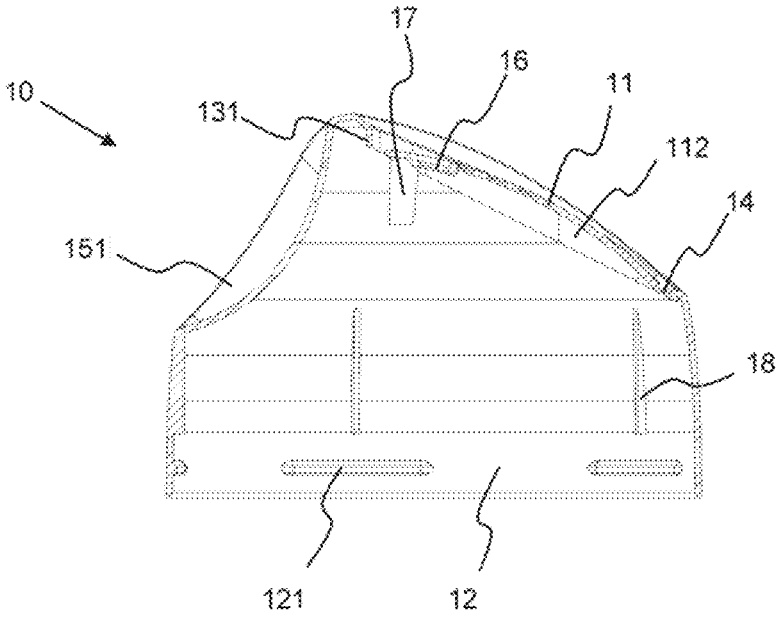
FIG. 9: A longitudinal cross-sectional view of the base body of FIG. 8.
Figure 10:
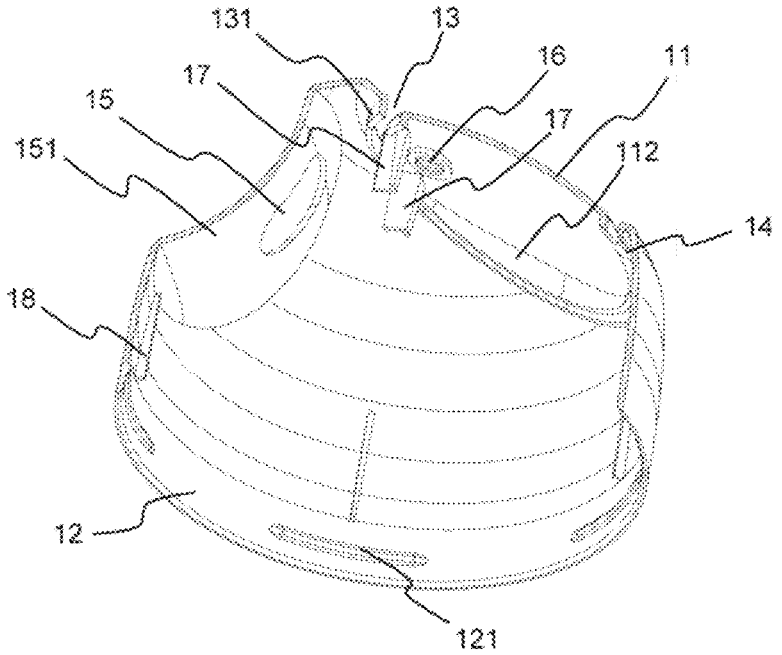
FIG. 10: A perspective view of an off-center longitudinal cross-section of the base body of FIG. 8.
Figure 11:
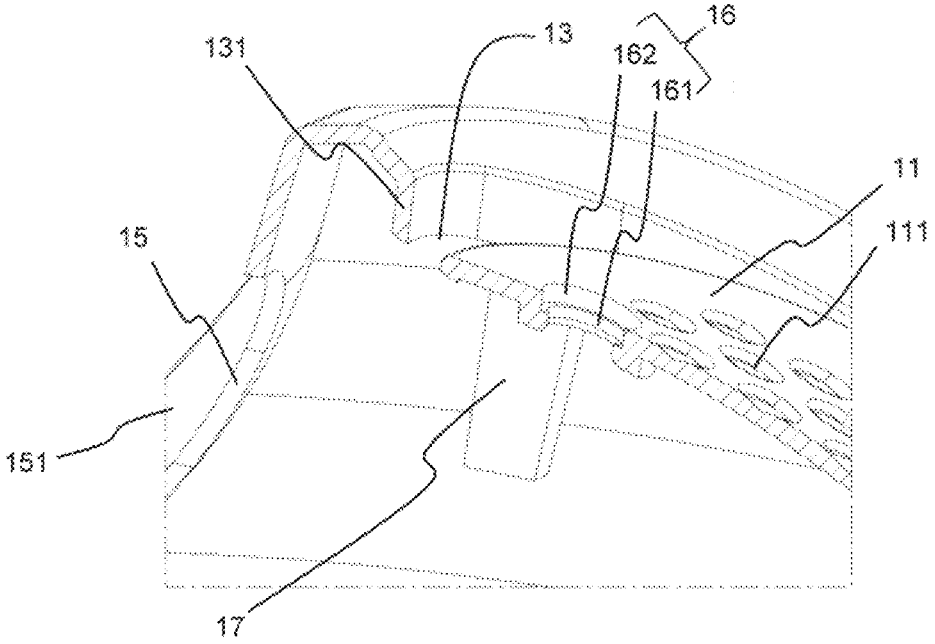
FIG. 11: An enlarged perspective view of a longitudinal cross-section of the base body at the fastening hole.
Figure 12:
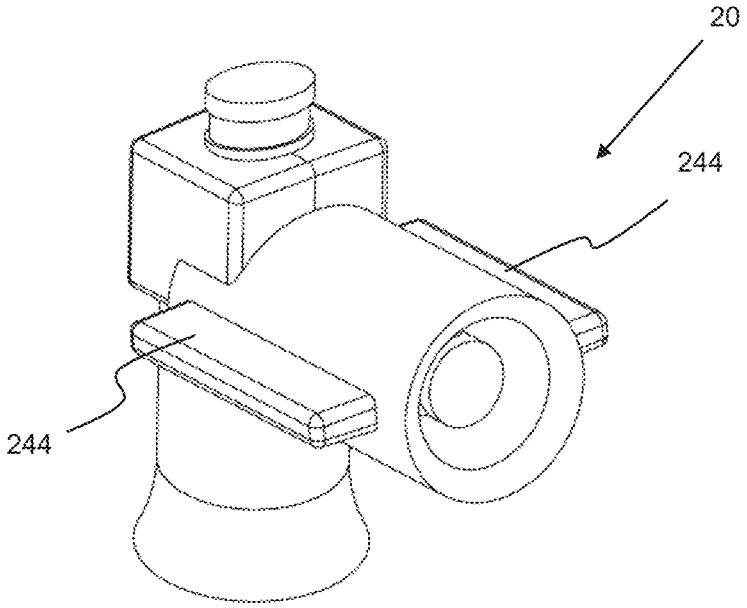
FIG. 12: A perspective view of a variant of the outlet conduit of FIG. 6.

The invention relates to a diffuser (1) for pressurized containers, in particular for aerosol generators, foam generators, distribution systems for gels, creams, pasty or liquid products, etc. It is intended to actuate the valve of the container in order to remove at least a portion of the contents of the container and to distribute it, for example in the form of an aerosol or a foam. Pressurized containers are generally constituted by a housing provided with a neck closed by a valve mounted on a valve cup. Sometimes the valve cup is fixed to the housing via a dome. When the valve is of the male type, a stem protrudes from the valve.

Conventionally, the diffuser comprises a base body (10) provided with a finger tab (11), and an outlet conduit (20) located inside the base body. The finger tab (11) serves as a push button to move the outlet conduit (20) towards the aerosol generator in order to actuate its valve. According to the invention, the outlet conduit (20) and the base body (10) are two distinct parts, the outlet conduit being configured to be fixed by fastening means to the base body.

The diffuser has a certain geometry of rotation about a main axis (A). The adjectives "radial" and "axial" refer to this main axis. When the diffuser is mounted on the pressurized container, this main axis (A) is aligned with the stem of the valve, or more generally with the main axis of the valve body. The base body is formed by a concave wall forming a cavity. Hereinafter, the terms "inside/inner" and "outside/outer" respectively qualify the elements which are in or towards the cavity and those which are outside or away from the cavity.

The outlet conduit (20) has a first end (21) configured to cooperate with the valve; for this purpose, it is provided at this first end with means for cooperating with the valve. If the valve is a female type valve, the end includes a rod intended to penetrate the valve to actuate it. If the valve is of the male type, the first end (21) is flared to facilitate introduction of the stem when mounting the diffuser on the pressurized container. The second end (22) of the outlet conduit opens to the outside and can be provided with a nozzle to improve the quality of the aerosol. If the product does not come out in alignment with the valve, the outlet conduit is divided between at least a first section (23) which is substantially rectilinear and a second section (24) which is inclined relative to the first. The first section begins at the first end (21) and ends at the junction with the second section (24), and the second section (24) begins at the junction with the first section (23) and ends at the second end (22). To allow installation of a nozzle, the second section (24) can be provided on the side of the second end with a nozzle housing (241). In the example presented here, the second section (24) is constituted by an inner conduit (242), which, strictly speaking, forms a portion of the outlet conduit and which is surrounded by a cylindrical wall (243) at least on the side of the second end (22). The annular space between the inner conduit (242) and the cylindrical wall (243) constitutes the nozzle housing. If the diffuser is not fitted with a nozzle, the cylindrical wall (243) can be omitted.

To fasten the outlet conduit (20) on the base body (10), fastening means are provided, a portion of which, located on the outlet conduit (20), cooperates with another complementary portion made in the base body (10). In the present example, the fastening means of the outlet conduit are constituted by a snap-fastening tenon (25) intended to snap into a snap-fastening opening of the base body constituting the complementary portion of the fastening means. The snap-fastening tenon (25) is placed at the top of the 1st section (23), opposite the first end (21). It is preferably coaxial with the axis (A), but this is not required. The snap-fastening tenon is constituted by a substantially cylindrical rod (251) fixed by its first end to the outlet conduit and carrying at its second end a cap (252) having a larger transverse cross-section. The junction between the rod (251) and the rest of the outlet conduit constitutes a shoulder (253) at a distance from the cap. In the present case, the tenon is actually a cylinder in which an annular groove is made. The top of the cylinder constitutes the cap (252), the annular groove forms the rod (251), and the portion of the cylinder opposite the cap acts as a shoulder (253).

The base body (10) is constituted by a concave wall. In the present example, it has the general shape of a dome. It could also be cylindrical. In its lower portion, located on the side of the housing of the pressurized container, the base body (10) is provided with a fixing ring (12) configured to fix it to the pressurized container, either directly, in particular on the housing or on the valve, or via a ferrule, in particular in the case of ON/OFF type diffusers. This fixing ring is provided with fixing means such as a series of gadroons (121) regularly distributed over the entire periphery of the fixing ring. These fixing means are intended to cooperate with complementary fixing means made on the housing or the valve of the pressurized container, or on the ferrule. In particular, the gadroons (121) can snap behind the rolled edge at the interface between the housing and the valve cup or between the housing and the dome on which the valve cup is fixed. Other fixing means can be envisaged, such as a continuous rib, a thread for screwing, an extra thickness of material for welding, glue for gluing, etc.

The wall of the base body is pierced by a finger tab opening (13) in which the finger tab (11) is placed. The finger tab is attached to the rest of the base body by a strip (14) which acts as a hinge so that when pressure is exerted on the finger tab towards the inside of the base body (therefore towards the valve when the diffuser is mounted on the pressurized container), the finger tab pivots around an axis that passes through the strip transversely. In the example presented here, the finger tab (11) and the corresponding opening (13) are placed towards the top of the base body. Preferably, the projection of the finger tab (11) on a plane perpendicular to the main axis (A) covers at least the projection of the first section (23) of the outlet conduit on said plane perpendicular to the main axis (A). In other words, the finger tab (11) is located above at least the top of the first section (23) of the outlet conduit.

An orifice (15) is made in the wall of the base body facing the second end (22) of the outlet conduit. The product taken from the pressurized container which leaves the outlet conduit through its second end (22) passes through this orifice (15). This orifice is preferably oblong and extends in an axial plane so that the 2nd end (22) of the outlet conduit, when it moves during actuation of the valve, always remains facing the orifice (15). Thus, the second end (22) of the outlet conduit is floating relative to the base body (10) and to the orifice (15) in particular.

A fastening hole (16) is made in the base body (10) to fix the outlet conduit (20). This hole constitutes the complementary fastening means for fixing the outlet conduit (20) to the base body (10). The fastening hole (16) is intended to receive and retain the fastening tenon (25) of the outlet conduit. It passes right through the wall of the base body. In the example presented here, it is divided into two portions: an inner portion (161) located towards the inside of the base body and an outer portion (162) opening on the outer face of the finger tab (11). The inner portion (161) is dimensioned to receive the rod (251) of the fastening tenon while the outer portion, which is wider, is dimensioned to receive the cap (252) of the tenon. The outer portion (162) and the cap are preferably dimensioned so that the top of the cap is flush with the outer face of the finger tab (11) and so that it is in its continuity. In particular, the length of the outer portion (162) of the fastening hole (measured between the junction with the inner portion (161) and the outer face of the wall of the base body) is preferably substantially the same as the height of the cap (252) (measured between the junction of the cap with the rod and the top of the cap opposite the rod). Thus, in the example presented here, the top of the cap (252) is not perpendicular to the rod, but slightly inclined to follow the slope of the finger tab at this location. The cap (252) and the inner portion (161) of the fastening hole are dimensioned so that the cap can be passed by force through the inner portion (161) of the fastening hole during assembly of the outlet conduit to the base body, without the need for too great a force which could break in particular the fastening tenon (25). In other words, the transverse cross-section of the cap (252) is greater than the transverse cross-section of the inner portion (161) of the fastening hole. More generally, it is sufficient that the greatest transverse extension of the transverse cross-section of the cap is greater than the greatest transverse extension of the transverse cross-section of the inner portion of the fastening hole. Once the cap has passed by force through the inner portion (161) of the fastening hole, it cannot pass again on its own, that is to say, without external force, in the opposite direction through this inner portion. During normal use of the diffuser, no particular force is exerted on the outlet conduit which might tend to move the fastening tenon out of the fastening hole. The fastening via snap-fastening the tenon in the fastening hole is therefore very well suited to a diffuser.

To prevent the outlet conduit (20) from pivoting around the fastening rod (251) at the risk that the second end (22) of the outlet conduit could be no longer aligned with the outlet orifice (15), it is preferable that the base body and/or the outlet conduit is/are configured to keep the 2nd end of the outlet conduit aligned with the product outlet orifice (15). For this purpose, anti-rotation means can be provided. In the present example, these anti-rotation means are constituted by two guide lugs (17). These guide lugs are located on the inner face of the base body, in this example, on the inner face of the finger tab (11), between the fastening hole (16) and the product outlet orifice (15). They are placed facing one another symmetrically relative to the longitudinal plane parallel to the main axis (A) and passing through the center of the fastening hole (16) and the outlet orifice (15). They are spaced from one another so as to grip, or at least surround with very little play, the outlet conduit (10). To facilitate installation of the outlet conduit (10), the distance between them can widen slightly in the direction towards the center of the base body.

To stabilize the base body (10), the edge of the finger tab opening (13) can be continued by a skirt (131) directed towards the center, which skirt also serves as a cover when the finger tab (11) is pressed. Likewise, the periphery of the finger tab carries a skirt (112) directed inward. Stop ribs (18) can also be provided in the cavity of the base body to limit the downward movement of the diffuser on the housing of the pressurized container.

Depending on the length of the second section (24) of the outlet conduit, it can be necessary to bring the product outlet orifice (15) closer to the center of the base body. For this purpose, the outlet orifice (15) is placed in a recess (151) of the wall of the base body, which recess is more or less deformed, in particular, concave as viewed from the outside of the base body, depending on the length of the second section (24) of the outlet conduit.

During assembly, the outlet conduit (20) is introduced into the cavity of the base body (10), with its second end (22) directed towards the outlet orifice (15). The fastening tenon (25) is introduced into the fastening hole (16). The cap (252) is passed by force through the inner portion (161) until it emerges into the outer portion (162), the transverse cross-section of which is sufficient to receive it. In this position, the rod (251) of the fastening tenon is placed in the inner portion (161) of the fastening hole and the shoulder (253) opposite the cap is in contact, or almost in contact, with the inner face of the finger tab (11). At the same time, the second section (24) of the outlet conduit passes between the two guide lugs (17) which by their shape guide the outlet conduit exactly in the alignment of the outlet orifice (15). Thus, the outlet conduit is retained, on the one hand, in axial translation by the blocking effect of the wall of the finger tab at the fastening hole between the cap (252) and the shoulder (253), and on the other hand, in rotation by the blocking of the second section (24) between the two guide lugs (17).

To prevent the user's finger from slipping on the finger tab, it is possible to provide it with reliefs (111). The cap (252) of the fastening tenon of the outlet conduit can merge among these reliefs for a more aesthetic effect. In particular, it is possible that the cap (252) is shorter than the outer portion (162) of the fastening hole, so that it is not flush with the outer face of the finger tab and forms a hole similar to the other reliefs.

Many variant embodiments are possible:

The shape of the cap (252) of the fastening tenon can be non-circular, therefore without symmetry of revolution. If the shape of the outer portion (162) is complementary and adjusted to that of the cap, it is even possible to dispense with the guide lugs (17) since the outlet conduit is blocked in rotation by interlocking of the shape of the non-circular cap in the upper portion of complementary shape. The non-circular shape of these two parts and their at least partial adjustment constitute anti-rotation means.

The outer portion (162) of the fastening hole does not necessarily have the same shape as the cap (252) of the fastening tenon. It is sufficient that the cap can be accommodated therein, even if it protrudes or is set back from the outer face of the base body, and even if it is not blocked in rotation, since the guide lugs, or a tight fit or the interlocking shape of the rod (251) in the inner portion (161) of the fastening hole, make it possible to block the outlet conduit from rotating.

It is possible to dispense with the outer portion (162) of the fastening hole by providing the rod (251) of the fastening tenon and the inner portion (161) of the fastening hole to be longer and by leaving the cap protruding above the outer face of the finger tab (11).

The fastening tenon can be constituted only by a rod penetrating by force into a corresponding hole in the base body. This hole does not need to be a through hole, a blind hole may be sufficient if the thickness of the base body at this location is enough. Here too, it is possible to dispense with the guide lugs since the tightening adjustment of the rod is sufficient to block the outlet conduit in rotation. If the fastening hole is a through hole, the shape or color of the fastening rod, or at least of its free end, can also serve as an indication, as will be explained below.

If the tenon does not have a cap and the fastening hole is a through hole, it is possible to provide that the free end of the rod of the tenon has a particular shape, for example a triangle, a star, etc., and that the outer portion (162) of the fastening hole has a complementary shape. For this purpose, the transverse cross-section of the free end of the rod can be identical to that of the rest of the rod (round for example) or be smaller or at least be inscribed in the transverse cross-section of the rest of the rod. The tight fit of the tenon in the hole can be limited to the inner portion (161) or to the outer portion (162) of the fastening hole.

The outlet conduit can be fixed to another portion of the base body (10), in particular in the longitudinal plane passing through the main axis (A) and the center of the product outlet orifice (15). For example, it can be provided to fix it between the fixing ring (12) and the product outlet orifice (15), or on the contrary, opposite the product outlet orifice (15). In such case, a bearing surface can be provided at the top of the outlet conduit, on which the finger tab (11) bears when the user depresses it to actuate the valve.

The outlet conduit (20) can be fixed to the base body by any other mechanical fastening means. For example, slots can be provided on the inner face of the base body, in which the side edges of the cap (252) can slide until the desired position where they can snap into place or be held in place due to the narrowness of the slots in that location. It is also possible to provide snap-fastening tenons on one of the parts and complementary snap-fastening slots on the other part.

The invention makes it possible to focus particularly on the outlet conduit (20), which is essential for the quality of spraying, the rest of the diffuser, namely the base body, being only a covering. It is possible to have very short channels, which is favorable in particular when using pressurized gases. The base body and the outlet conduit can be manufactured in different factories, which limits the problems associated with transportation. The same outlet conduit can be used with base bodies of different colors and/or materials, and the same base body can be used with outlet conduits of different qualities. Many combinations are therefore possible.

Thanks to the invention, it is possible to use two different materials for the outlet conduit (20) and for the base body (10). The material of the outlet conduit will be chosen to be compatible with the product to be withdrawn, whereas the material of the base body will not need to fulfill this condition, but can be chosen for its mechanical properties in particular. For example, if the diffuser is intended for a food product, the material of the outlet conduit will need to be a food-grade material, while that of the base body will not need to be and can be more economical. By using mechanical fastening means, in particular by snap-fastening, it is not necessary for the two materials to be compatible with each other. It is also not necessary to provide a bi-material injection. Among the materials that can be envisaged for the base body, one can cite polymeric materials (PE, PP, PLA, PHA, PBS) whether they are virgin or recycled, derived from petroleum or natural resources, biodegradable or not, or even compostable or no. They can contain mineral fillers (glass, basalt, etc.), be reinforced by mineral fibers or vegetable. It is also possible to envisage non-polymeric materials, such as lignin-based materials (cardboard, wood), materials containing textiles, metals, etc. For the outlet conduit, mention can be made, by way of non-limiting example, of polymers (PE, PP, POM, PBT, PA, etc.) or metals (aluminum, steel, in particular stainless steel).

The end of the rod, in particular the cap, and/or the fastening hole can be configured to convey information to the user. The color and/or the shape of the end of the rod, and in particular of the cap (252), can serve as information for the user, and in particular as means of identification. For example, if at least one of the two materials is a biomaterial or a recycled material, it is possible for example to color the outlet conduit in green so that the cap (252) forms a green patch on the finger tab. A manufacturer will thus be able to communicate to its customers about its strategic desire to be part of a sustainable development policy. It is also possible to give the cap a shape other than circular. For example, it could be given the shape of a star or a crescent moon, which could be used not only as an anti-rotation means, but also to indicate that the product inside is intended to be used in the evening (for example, a night cream).

To facilitate handling of the outlet conduits, they can be fitted with assembly fins (244), in particular on the second section (24), which make it possible to correctly guide the outlet conduits in the assembly machine.

Since the fastening tenon can be at a certain distance from the junction between the first section (23) and the second section (24) of the outlet conduit, it is preferable to provide a hollow (26) in the material located between this junction and the fastening tenon. In the example presented here, the shoulder (253) of the fastening tenon is placed on the upper wall of this hollow.

LIST OF REFERENCE SIGNS

1 Diffuser
10 Base body
- 11 Finger tab
- 111 Anti-slip reliefs
- 112 Reinforcement skirt
- 12 Fixing ring
- 121 Fixing means
- 13 Finger tab opening
- 131 Reinforcement skirt
- 14 Strip
- 15 Product outlet orifice
- 151 Recess
- 16 Fastening hole
- 161 Inner portion
- 162 Outer portion
- 17 Guide lugs
- 18 Stop ribs

20 Outlet conduit
- 21 1st end
- 22 2nd end
- 23 1st section
- 24 2nd section
- 241 Nozzle housing
- 242 Inner conduit
- 243 Cylindrical wall
- 244 Assembly fins
- 25 Fastening tenon
- 251 Rod of the snap-fastening tenon
- 252 Cap of the snap-fastening tenon
- 253 Shoulder
- 26 Hollow A Main axis

The invention claimed is:

1. A diffuser for a pressurized container provided with a valve, wherein the diffuser comprises:

a base body comprising a wall having a concave inner face forming a cavity, the base body including a finger tab intended to be depressed by a user to actuate the valve, and an outlet conduit placed in the cavity of the base body, the conduit having a first end adapted for cooperating with the valve of the pressurized container, and a second end for outlet of a product contained in the pressurized container, wherein the outlet conduit and the base body are two distinct parts which are connected together by mechanical fastening means, wherein the mechanical fastening means include a fastening tenon and a fastening hole, the fastening tenon being placed on the outlet conduit and the fastening hole being made in the wall of the base body and opening into the cavity, wherein the fastening hole is a through hole passing through the wall of the base body, wherein an inner side of the through hole opens into the cavity of the base body and an outer side of the through hole opens to an outside of the base body, wherein the fastening tenon extends in the fastening hole.

2. The diffuser according to claim 1, wherein:

the fastening tenon comprises a cap connected to the outlet conduit by a rod which ends with a shoulder opposite the cap, and the fastening hole comprises at least a first portion, called inner portion, a greatest transverse extension of which is less than a greatest transverse extension of the cap of the fastening tenon, a length of the rod of the tenon being chosen so that, in a fastened state of the outlet conduit, the wall of the base body at an edge of the fastening hole is located between the cap and the shoulder, a transverse cross-section of the cap and a transverse cross-section of the inner portion being chosen so that when fastening the outlet conduit, the cap can be introduced by force into the inner portion of the fastening hole without risking damage to the outlet conduit or to the base body.

3. The diffuser according to claim 2, wherein the inner portion of the fastening hole continues with a second portion, called outer portion, the inner portion opening into the cavity of the base body and the outer portion opening to the outside of the base body, a transverse cross-section of the outer portion being dimensioned to contain the transverse cross-section of the cap of the fastening tenon.

4. The diffuser according to claim 2, wherein anti-rotation means are provided to prevent the outlet conduit from rotating relative to the base body, the anti-rotation means being constituted by an interlocking of shapes of the cap of the fastening tenon in the outer portion of the fastening hole, the transverse cross-section of the cap of the fastening tenon and a transverse cross-section of the outer portion of the fastening hole not having a symmetry of revolution.

5. The diffuser according to claim 1, wherein the outlet conduit comprises a first section which is rectilinear and a second section, the first section starting at the first end of the outlet conduit and ending at a junction with the second section, the fastening tenon is placed at a top of the first section opposite the first end, or on the second section, and the fastening hole is made in the finger tab.

6. The diffuser according to claim 1, wherein anti-rotation means are provided to prevent the outlet conduit from rotating relative to the base body, the anti-rotation means being constituted by a tight fit of the fastening tenon in the fastening hole.

7. The diffuser according to claim 1, wherein anti-rotation means are provided to prevent the outlet conduit from rotating relative to the base body, the anti-rotation means being constituted by an interlocking of shapes of the fastening tenon in the fastening hole, a transverse cross-section of the fastening tenon and a transverse cross-section of the fastening hole not having a symmetry of revolution.

8. The diffuser according to claim 1, wherein anti-rotation means are provided to prevent the outlet conduit from rotating relative to the base body, the anti-rotation means being constituted by two guide lugs placed in the cavity of the base body and which surround a portion of the outlet conduit while preventing the outlet conduit from pivoting around the fastening tenon.

9. The diffuser according to claim 1, wherein a material used for the base body and a material used for the outlet conduit are of different compositions, of different colors, or both of different compositions and different colors.

10. The diffuser according to claim 1, wherein an end of the fastening tenon opposite a rest of the outlet conduit has a shape, a color, or both a shape and a color, which, in a fastened state of the outlet conduit, is/are visible and recognizable from an outside of the diffuser and convey identification or information for a user.

11. The diffuser according to claim 1, wherein the base body is provided with fixing means to fix the base body directly or via a ferrule to the pressurized container.

12. The diffuser according to claim 1, wherein an orifice is made in the wall of the base body, facing the second end of the outlet conduit and at a distance from the fastening hole.

13. The diffuser according to claim 1, wherein at least a portion of the base body, at least a portion of the outlet conduit, or both at least a portion of the base body and at least a portion of the outlet conduit, is/are made in a material selected from the group consisting of recycled materials, biodegradable materials, compostable materials, biomaterials, and mixtures of two or more thereof.

14. The diffuser according to claim 1, wherein the base body is made in a material selected from the group consisting of:

polymer materials, polymer materials containing mineral fillers, polymer materials reinforced with mineral fibers, vegetable fibers, or both mineral and vegetable fibers, lignin-based materials, materials containing textiles, metals, and mixtures of two or more thereof.

15. The diffuser according to claim 1, wherein the outlet conduit is made in a material selected from the group consisting of food grade materials, cosmetic grade materials, pharmaceutical grade materials, medical grade materials, and mixtures of two or more thereof.

16. The diffuser according to claim 1, wherein the outlet conduit is made in a material selected from the group consisting of polymers, metals, and mixtures of two or more thereof.

17. The diffuser according to claim 1, wherein the outlet conduit is made in a virgin material and the main body is made at least partly in a recycled material.

18. A base body for a diffuser for a pressurized container provided with a valve, wherein the base body comprises:

a wall having a concave inner face forming a cavity, and a finger tab intended to be depressed by a user to actuate the valve, wherein the base body is adapted to cooperate with an outlet conduit of the diffuser adapted to be placed in the cavity of the base body, the outlet conduit having a first end adapted for cooperating with the valve of the pressurized container, and a second end for outlet of a product contained in the pressurized container, and wherein the base body is adapted to be connected together with the outlet conduit by mechanical fastening means, the base body comprising a portion of the mechanical fastening means, the base body and the outlet conduit being two distinct parts, wherein the portion of the mechanical fastening means in the base body is a fastening hole adapted to receive a fastening tenon placed on the outlet conduit and comprising a cap connected to the outlet conduit by a rod which ends with a shoulder opposite the cap, wherein the fastening hole comprises at least a first portion, called inner portion, a greatest transverse extension of which is less than a greatest transverse extension of the cap of the fastening tenon, a length of the rod of the tenon being chosen so that, in a fastened state of the outlet conduit, the wall of the base body at an edge of the fastening hole is located between the cap and the shoulder, a transverse cross-section of the cap and a transverse cross-section of the inner portion being chosen so that when fastening the outlet conduit, the cap can be introduced by force into the inner portion of the fastening hole without risking damage to the outlet conduit or to the base body, and wherein the inner portion of the fastening hole continues with a second portion, called outer portion, the inner portion opening into the cavity of the base body and the outer portion opening to an outside of the base body, a transverse cross-section of the outer portion being dimensioned to contain the transverse cross-section of the cap of the fastening tenon.

19. A diffuser for a pressurized container provided with a valve, wherein the diffuser comprises:

a base body comprising a wall having a concave inner face forming a cavity, the base body including a finger tab intended to be depressed by a user to actuate the valve, and an outlet conduit placed in the cavity of the base body, the conduit having a first end adapted for cooperating with the valve of the pressurized container, and a second end for outlet of a product contained in the pressurized container, wherein:

the outlet conduit and the base body are two distinct parts which are connected together by mechanical fastening means, the mechanical fastening means include a fastening tenon and a fastening hole, the fastening tenon is placed on the outlet conduit and the fastening hole is made in the base body, the fastening tenon comprises a cap connected to the outlet conduit by a rod which ends with a shoulder opposite the cap, and the fastening hole is a hole passing through the wall of the base body, the hole comprising at least a first portion, called inner portion, a greatest transverse extension of which is less than a greatest transverse extension of the cap of the fastening tenon, a length of the rod of the tenon being chosen so that, in a fastened state of the outlet conduit, the wall of the base body at an edge of the fastening hole is located between the cap and the shoulder, a transverse cross-section of the cap and a transverse cross-section of the inner portion being chosen so that when fastening the outlet conduit, the cap can be introduced by force into the inner portion of the fastening hole without risking damage to the outlet conduit or to the base body.

20. Diffuser according to claim 19, wherein the inner portion of the fastening hole continues with a second portion, called outer portion, the inner portion opening into the cavity of the base body and the outer portion opening to an outside of the base body, a transverse cross-section of the outer portion being dimensioned to contain the transverse cross-section of the cap of the fastening tenon.

21. Diffuser according to claim 19, wherein anti-rotation means are provided to prevent the outlet conduit from rotating relative to the base body, the anti-rotation means being constituted by an interlocking of shapes of the cap of the fastening tenon in the outer portion of the fastening hole, the transverse cross-section of the cap of the fastening tenon and a transverse cross-section of the outer portion of the fastening hole not having a symmetry of revolution.

* * * * *